US005915426A

United States Patent [19]

Gupte et al.

[11] Patent Number: 5,915,426

[45] Date of Patent: Jun. 29, 1999

[54] APPARATUS AND PROCESS FOR CLEANING THE OUTSIDE OF CONTAINERS

[75] Inventors: Arun R. Gupte, Ingelheim; Heinrich Kladders, Mulheim; Stefan Kruger, Appenheim, all of Germany

[73] Assignee: Boehringer Ingelheim KG, Ingelheim am Rhein, Germany

[21] Appl. No.: 08/776,975

[22] PCT Filed: Aug. 10, 1995

[86] PCT No.: PCT/EP95/03171

§ 371 Date: Jul. 14, 1997

§ 102(e) Date: Jul. 14, 1997

[87] PCT Pub. No.: WO96/05134

PCT Pub. Date: Feb. 22, 1996

[30] Foreign Application Priority Data

Aug. 11, 1994 [DE] Germany ..... 44 28 433

[51] Int. Cl.[6] ..... A65B 1/04

[52] U.S. Cl. ..... 141/91; 141/85; 141/89; 141/93; 15/345; 422/302

[58] Field of Search ..... 141/85, 89, 90, 141/91, 93; 15/300.1, 309.2, 345; 422/302

[56] References Cited

U.S. PATENT DOCUMENTS

| | | | |
|---|---|---|---|
| 1,714,075 | 5/1929 | Carvalho | 141/89 |
| 2,701,086 | 2/1955 | Purse et al. . | |
| 3,786,614 | 1/1974 | Mistarz . | |
| 4,262,708 | 4/1981 | de Echeandia et al. . | |
| 4,991,633 | 2/1991 | Wong | 141/5 |
| 5,226,863 | 7/1993 | Kimura | 141/8 |
| 5,262,578 | 11/1993 | Hall | 141/93 |

FOREIGN PATENT DOCUMENTS

| | | |
|---|---|---|
| 92 10 753 | 10/1992 | Germany . |
| 2056658 | 3/1981 | United Kingdom . |

*Primary Examiner*—David J. Walczak
*Assistant Examiner*—Timothy L. Maust
*Attorney, Agent, or Firm*—Robert P. Raymond; Alan R. Stempel; Mary-Ellen Devlin

[57] ABSTRACT

An apparatus for cleaning the outside of a container to remove any adhering liquid, particularly in the region of a fill opening thereof. Adhering liquid is blown off of the container by mean of compressed air.

2 Claims, 1 Drawing Sheet

APPARATUS AND PROCESS FOR CLEANING THE OUTSIDE OF CONTAINERS

Figure 1:
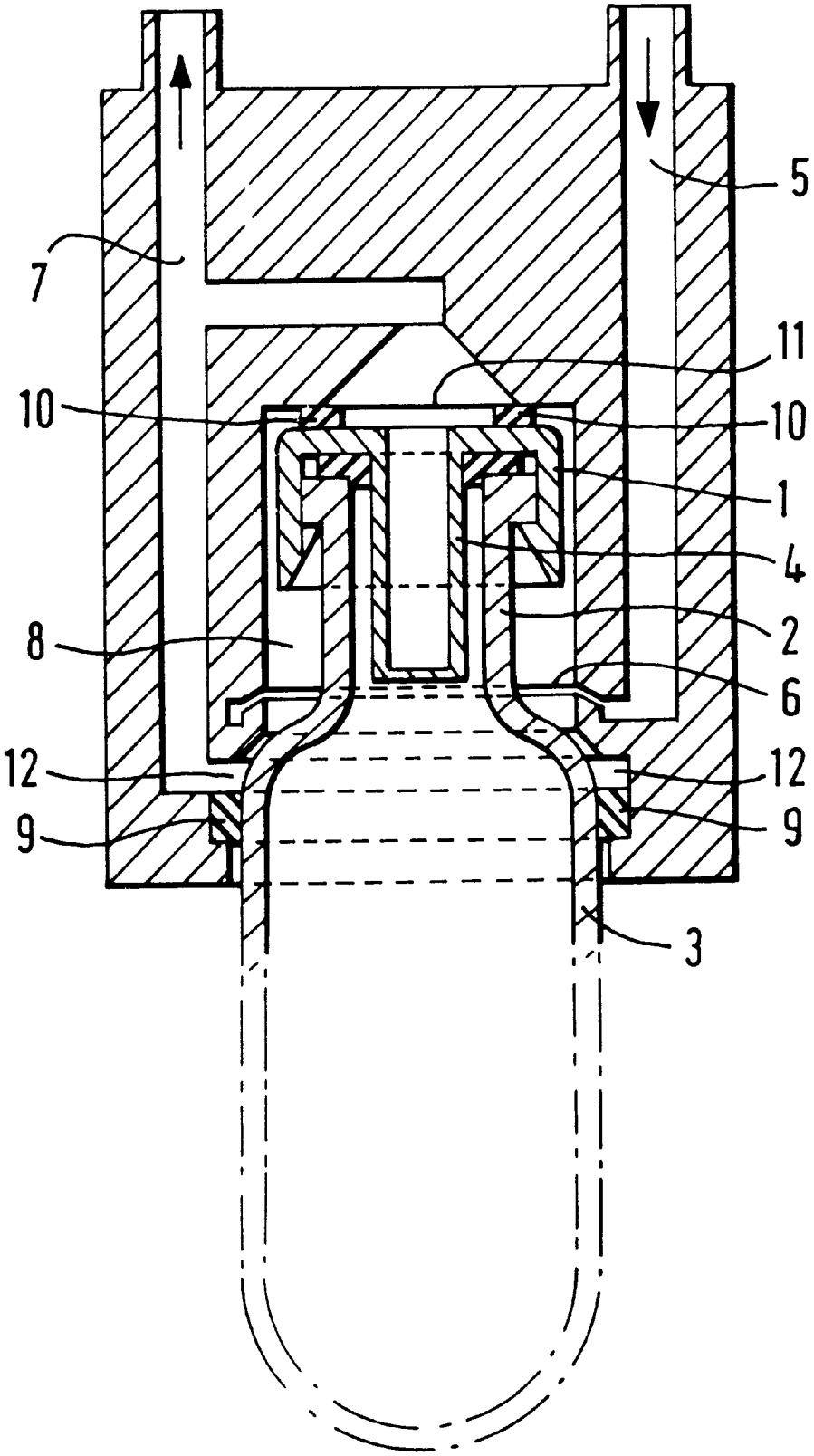

The invention relates to an apparatus by means of which containers soiled with liquid, particularly in the region of their fill opening, can be cleaned, and to a process with which the cleaning can be carried out using the new apparatus.

When filling containers, such as containers for pharmaceutical solutions, efforts are sometimes made to avoid the inclusion of residues of gas/air. For this purpose, the container is filled as much as possible and then fitted with a closure, the fitting on of which causes some of the liquid to be displaced from the container, thereby simultaneously eliminating any residual gas/air. The displaced liquid soils the container, mainly in the region of the neck, which is then closed.

According to the invention, an apparatus is now proposed which, by the use of compressed air and optionally suction means, eliminates the contaminating liquid displaced from the container as the closure cap is fitted on.

An apparatus of this kind is shown in FIG. 1.

The apparatus according to FIG. 1 simultaneously serves to push the cap 1 on to the neck 2 of the container 3, where it engages in the end position and tightly seals the container. This container is initially substantially full, so that when the cap 1 is fitted on the nozzle 4 it displaces a small amount of the contents of the container; in this way, all the residual air or gas is eliminated from the neck of the container. On the other hand, a certain amount of liquid overflows, soiling the neck of the container.

The overflowing liquid can be removed by means of the present invention. In order to achieve this, the liquid is blown away using jets of compressed air and the mixture (mist) of air and liquid droplets is eliminated from the apparatus by means of the air flow or, preferably, sucked out.

The compressed air is delivered through the air channel 5 to the slot-shaped, encircling nozzle 6. At the same time, in the preferred embodiment, the vacuum applied to the channel 7 ensures that underpressure prevails in the chamber 8 surrounding the neck of the container 3. The chamber 8 is also outwardly sealed off by the encircling seal 9.

Between the upper inner wall of the chamber 8 and the cap 1 of the container 3, one or more spacers 10 ensure that the mist of air and liquid droplets can be eliminated or sucked out through the opening 11 attached to the channel 7 and through the encircling opening 12.

Instead of only one slotted nozzle, a plurality may be provided above one another, if desired. It is also appropriate to use individual radially or tangentially arranged nozzles with, for example, round or rectangular openings.

After the cleaned container has been removed, the next container may be placed in the apparatus with its cap put on loosely, then sealed and cleaned.

We claim:

1. An apparatus for cleaning the outside of a container to remove any adhering liquid, particularly in the region of a fill opening thereof, said apparatus comprising:

(a) a chamber (8) adapted to receive an upper part of the container;

(b) a seal (9) adapted to abut on the container wall and thereby seal the chamber;

(c) a compressed air supply means (5) connected to at least one encircling slotted nozzle (6) that is perpendicular to the longitudinal axis of the container, for directing air at the upper part of a container in the apparatus, in order to blow away the liquid; and, (d) a channel (7) having openings (11, 12) for removing mist thereby formed.

2. An apparatus according to claim 1 wherein an underpressure is applied to the channel (7) in order to eliminate the mist from the chamber (8).

* * * * *